United States Patent [19]

Piras et al.

[11] 4,067,793

[45] Jan. 10, 1978

[54] AUTOMATIC REMOTE CONTROL SYSTEM FOR MERCURY CELLS FOR THE PRODUCTION OF CHLORINE AND CAUSTIC SODA

[75] Inventors: Giancarlo Piras; Alberto Bicocchi, both of Milan, Italy

[73] Assignee: Euteco S.p.A., Milan, Italy

[21] Appl. No.: 775,359

[22] Filed: Mar. 7, 1977

[30] Foreign Application Priority Data

Mar. 11, 1976 Italy ..... 21065/76

[51] Int. Cl.[2] ..... C25B 15/02; C25B 15/04

[52] U.S. Cl. ..... 204/219; 204/225; 204/228

[58] Field of Search ..... 204/99, 219–220, 204/250, 225, 228

[56] References Cited

U.S. PATENT DOCUMENTS

| | | | |
|---|---|---|---|
| 3,531,392 | 9/1970 | Schmeiser | 204/225 |
| 3,734,848 | 5/1973 | Bertoni et al. | 204/228 |
| 3,853,723 | 12/1974 | Mack | 204/99 |
| 4,004,989 | 1/1977 | Ralston, Jr. | 204/99 |

FOREIGN PATENT DOCUMENTS

| | | | |
|---|---|---|---|
| 1,212,488 | 11/1970 | United Kingdom | 204/225 |

*Primary Examiner*—Donald L. Walton
*Assistant Examiner*—D. R. Valentine
*Attorney, Agent, or Firm*—Sughrue, Rothwell, Mion, Zinn and Macpeak

[57] ABSTRACT

In a computer-controlled mercury cell plant comprising a cell room, a mercury cell in the cell room, a control room remote from the cell room, and a central control apparatus including a memorized program digital computer arranged to adjust the height of anode banks in the cell in response to analog signals supplied by anode current sensors associated with the banks, a substation is provided in the cell room by means of which the analog signals are multiplexed, digitalized, encoded and serialized before leaving the cell room and are sent to the central control apparatus through a telephonic loop. The substation is preferably situated adjacent a front end of the cell at a distance not exceeding 2 meters. Signal disturbances and use of bundles of cables are thus avoided.

3 Claims, 3 Drawing Figures

AUTOMATIC REMOTE CONTROL SYSTEM FOR MERCURY CELLS FOR THE PRODUCTION OF CHLORINE AND CAUSTIC SODA

This invention relates to a system of automation of a mercury cell, disposed in a cell room and comprising a plurality of anodes grouped in a plurality of anode banks each controlled by a motor for vertical adjustment of the bank, and in which the position in height of each anode bank is subject to watch and correction by a memorized program digital computer, provided in a control room remote from the cell room, as a function of analog signals proportional to the flows of current in the anodes of the respective bank.

A system of this type is described, for example, in U.S. Pat. No. 3,853,723. Further similar systems are described in U.S. Pat. No. 3,531,392 and in British Pat. No. 1,212,488.

As is known, a typical mercury cell comprises a narrow, long (even 20 meters or more) tank, having a conductive bottom, lightly inclined towards one of the ends of the cell. On the bottom a layer of mercury amalgam, functioning as a cathode, flows continuously, on which there flows in turn a layer of aqueous sodium chloride solution (electrolyte). Numerous anodes of carbon (graphite or metal, disposed in transverse rows, dip into the electrolyte. The anodes of one row, or of further adjacent rows, are mechanically connected in a single assembly or "bank," raisable and lowerable by means of a suitable motor. Above each bank there extends transversely of the cell a copper bus bar, to which each of the anodes is connected by means of a branch bar, also of copper. In general, in a cell room there are disposed numerous cells, parallel to each other, and the bus bars of one cell are electrically connected to the conductive bottom of the succeeding cell so that, from the electrical point of view, the cells are connected in series. In operation, gaseous chlorine is liberated at the anode, while metallic sodium is liberated at the cathode and forms an amalgam with the mercury.

For a correct operation of a cell room it would be necessary for the current passing between each of the anodes and the cathode in each cell to constantly maintain a predetermined value. It is also evident that an undue variation of current in an anode disturbs the balance of the entire system. On the other hand, however, variations of anode current are inevitable in practice (for reasons well known in the art). Neither is it a rarity to have localized short circuits, between one of the anodes and the cathode, which lead to very strong unbalances of the current, can damage the anode involved and give rise to a development of explosive hydrogen/chlorine mixtures. Consequently, it is extremely important to be able to constantly watch the working conditions of the anodes in each bank and to intervene timely when the effective conditions tend to differ undesirably from those predetermined.

According to the modern technique, the task of whatching and intervening is played by a control apparatus comprising a digital computer disposed in a control room remote from the cell room. In practice (see also U.S. Pat. No. 3,853,723), each anode or anode bank of a cell has associated therewith a sensor which supplies an analog electrical signal indicative of the value of the current passing through said anode or anode bank. The signals from all sensors are continuously transmitted to the control room by means of bundles of connecting cables and are converted (in the latter room) into corresponding numeric signals. The computer sequentially reads all the numeric signals in accordance with its memorized program, compares them with the memorized corresponding nominal values (or limit-values) and, in the case of discrepancy or incipient discrepancy, provides for the activation of suitable warning and control means. In particular, the motor of that anode bank from which the computer has received an irregularity signal, is energized in the raising or lowering direction, so as to neutralize the cause of the irregularity. Moreover, the computer is operatively connected with a control console typically comprising a command keyboard, a video monitor, a printer, optical and/or acoustic pre-alarm and alarm signals, etc., by which the operator is enable to supervise the entire system.

The analog signals furnished by the single sensors are usually in the form of electrical voltages and can be obtained by detecting the voltage drop along a convenient length of the feed bar of each of the anodes or of the feeding bus bar of each bank. For this purpose it is preferred to pick up the continuous voltage from the ends of a shunt member bridging said length of bar. Usually the shunt member is in the form of a bridge circuit and includes suitable PTC resistors, whereby the voltage picked up is independent of variations in temperature. The value of a signal thus obtained is of the order of millivolts. The signals can be "read" in various ways. The present invention refers to the way in which the reading is effected by means of a coded address multiplexer, to which the signals of all the sensors are inflowing in parallel. According to the present state of the art, the multiplexer is incorporated by the apparatus situated in the control room and is controlled by the computer. More precisely, the computer generates at a programmed moment an inquiry signal having a determined address, which goes to the multiplexer; thus, the analog signal being found at that address is communicated to the computer through an amplifier and an analog-to-digital (A/D) converter. The normal routine of the computer is that of sequentially inquiring, in a continuous succession of cycles, all the sensors in the manner just described above and comparing the readings with its memorized nominal values or ranges of values. The output signals are "error signals" and are transmitted to an output multiplexer which controls the motors of the anode banks and to which the video monitor, the keyboard and the optical and/or acoustic warning means are operatively connected. Thus, an error signal deriving from an anode of a determined anode bank serves to command the adjusting motor of the same bank.

The systems like that described above, currently known, present the inconvenience of being extremely sensible to disturbances. The disturbances are principally due to the fact that the currents which cross a cell room amount to hundreds of kA and thus generate intense magnetic fields, which continually vary with the variation of the currents in the single bars and thus generate false signals or at any event produce alterations in the signals which are received at the control room. The solutions studied up to the present have not produced satisfactory results. The present invention permits a drastic and reliable reduction in the disturbance effects abovementioned. According to the invention, the system of automation as defined hereinbefore is essentially characterized in that each of the analog signals is converted into a corresponding digital signal in a multiplexing-conversion-coding-serializing sub-station, which is situated in the cell room and sends the digital signals, in coded and serialized form, to the control room through a common transmission line, the multiplexer in said substation being controlled by said computer through the same or another transmission line.

Owing to the said substation, provided in the cell room, the travel distance of each analog signal is small as compared with the travel distance separating the respective sensor from the control room. It has been found that by reducing (preferably as drastically as possible) the travel distance of the analog signal with respect to the total travel distance it is possible to control the influence of the sources of disturbance mentioned above. Preferably, the substation is adjacent to one end of its associated cell, and the conductor wires which connect the substation with the single sensors are essentially (or prevalently) orthogonal to the bus bars, whereby the influence of the magnetic fields on the signals in the wires is reduced to a minimum. In a practical embodiment of the invention, the substation is situated on the prolongation of the respective cell, at a distance not greater than about two meters (preferably not greater than one meter). Naturally, for each cell there is provided a substation. Each substation is operatively connected with the control room preferably by means of two telephonic loops: a loop for the information signals, directed to the computer, and a second loop for the injury signals directed to the multiplexer from the computer. However, if desired, a single loop can serve for the transmission of both types of signals.

An embodiment of the invention will now be described, by way of example, referring to the accompanying drawings, in which.

Figure 1:
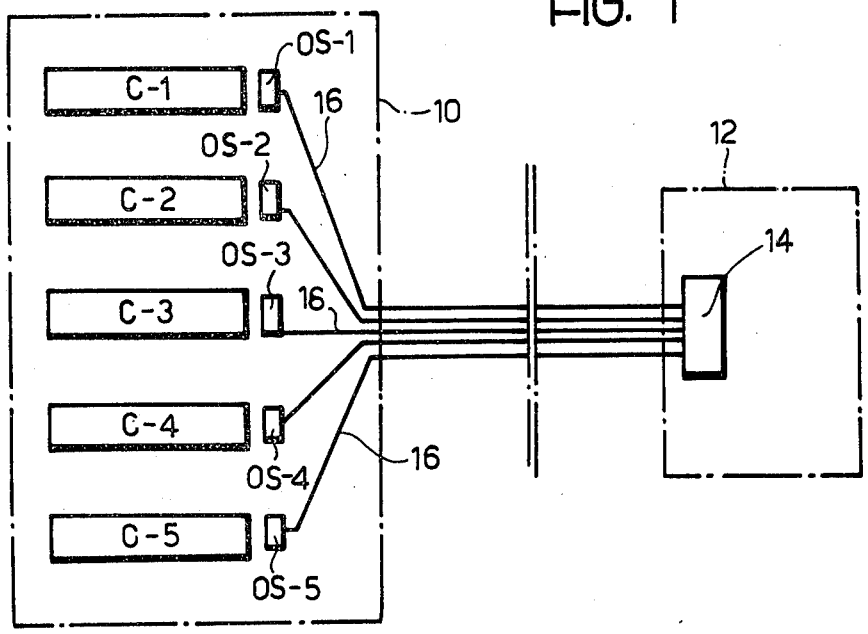
FIG. 1 is a schematic plan view of a chlorine/soda plant.

In FIG. 1 reference numeral 10 denotes the perimeter of a cell room in which there are provided five mercury cells indicated as C-1, C-2, . . . C-5, all being parallel to one another. In front of one end of each cell, at a distance of about 1 meter, there is provided a substation OS-1, OS-2 . . . OS-5, respectively. Reference 12 indicates the control room, in which is provided the central control apparatus indicated globally at 14. The substations OS-1, . . . OS-5 are connected with the central control apparatus 14 by means of cables 16, each constituted by a pair of telephonic loops denoted by 18 and 20 in FIG. 3.

The cells C-1, . . . C-5 are identical; also identical are the substations OS-1, . . . OS-5.

Figure 2:
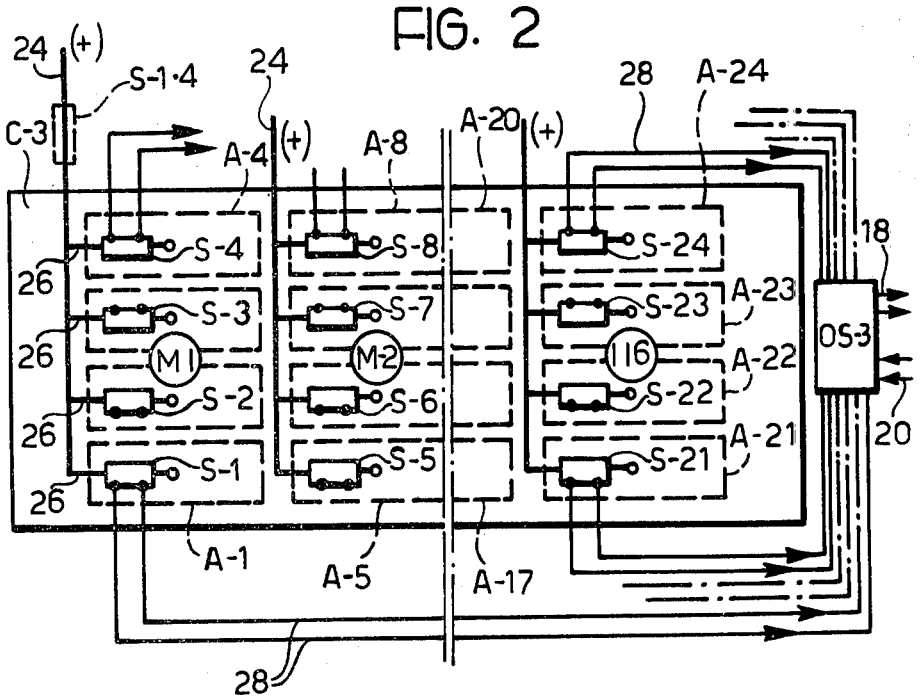
FIG. 2 is a schematic plan view of a cell with its relative electrical connections.

FIG. 2 shows cell C-3 as example valid for all other cells. In the example illustrated the cell comprises 24 anodes A-1, A-2, . . . A-24, grouped in six transverse rows of four anodes each. The anodes A-1 . . . A-4 of the first row form, in a manner known per se, a single anode bank, raisable and lowerable in a way known per se by an electric motor M-1. Similarly, a second anode bank is formed by the anodes A-5, . . . A-8 and is controlled by a motor M-2, and so on up to the last bank formed by the anodes A-21 . . . A-24 and controlled by a motor M-6. Extending transversely above the cell, for each anode bank there is provided a bus bar 24, from which there extend branch bars 26 for each of the anodes of the respective bank. On each of the branch bars 26 there is applied a sensor, advantageously comprised of a resistor bridge circuit as mentioned above; the sensors are indicated at S-1, S-2, . . . S-24, respectively, it being understood that the sensor S-1 relates to the anode A-1, the sensor S-2 relates to the anode A-2, and so on. As an alternative, for all the anodes of the same bank, there can be provided a common sensor, disposed on the relative bus bar 24. A sensor of this type, associated with the anodes A-1, . . . A-4, is indicated in FIG. 2 as S-1.4. Each of the sensors furnishes an analog signal (of voltage) which is proportional to the flow of the current in the respective anode, and the signals of all the sensors are separately transmitted to the substation OS-3 by means of pairs of conductor wires such as those denoted by 28, extending parallel to the cell, that is at right angles to the bus bar 24. Each sensor comprises a PTC resistor (or is provided with another means of compensation), by which the analog signal furnished by it to the substation OS-3 is already compensated with regard to temperature.

Figure 3:
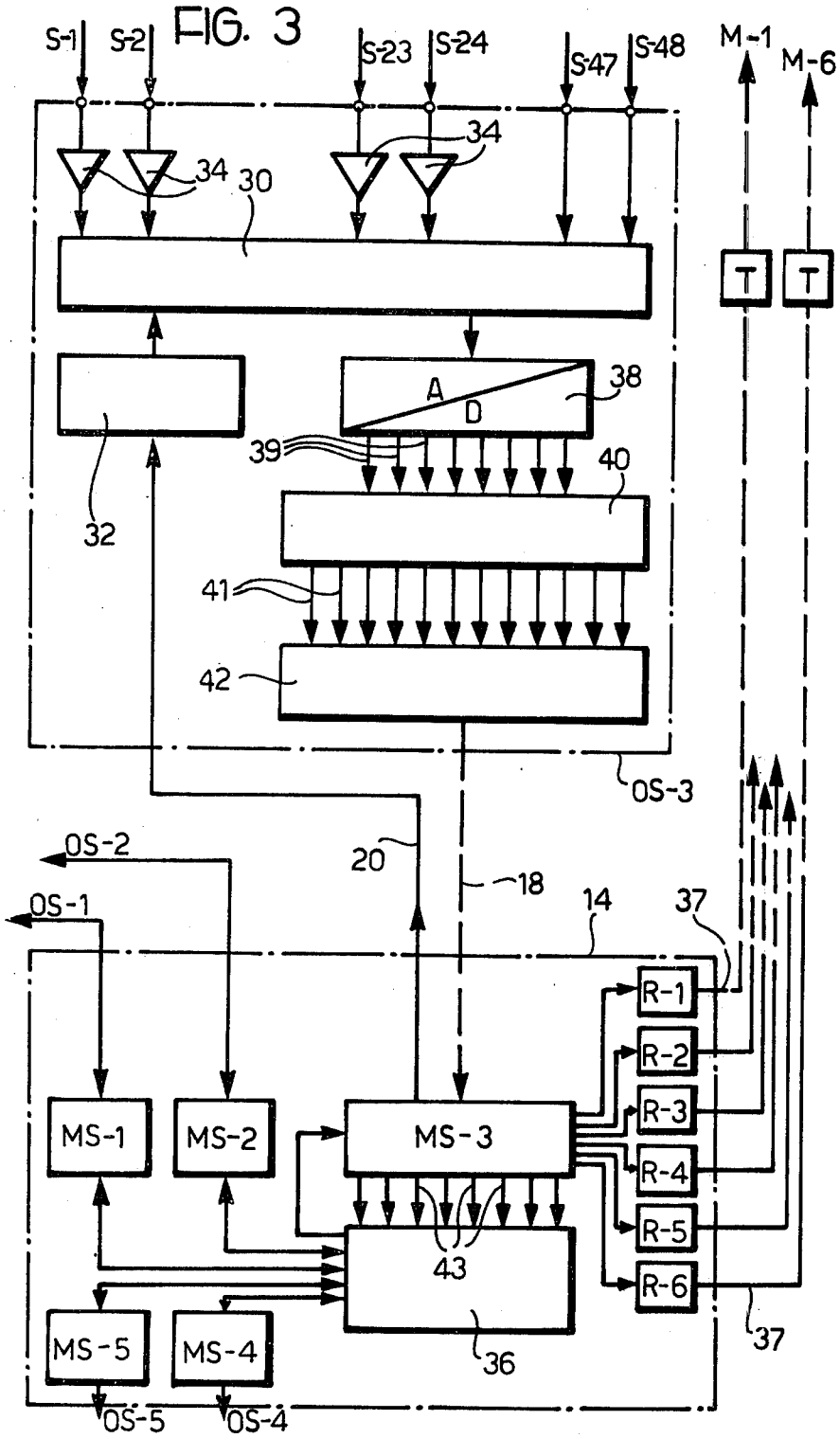
FIG. 3 is a block diagram of one of the substations and of the relevant apparatus in the control room.

The substation OS-3, illustrated in more detail in FIG. 3, first of all comprises a multiplexer 30 with the relative inquiry section 32. The multiplexer 30 has twentyfour inputs for the signals of the twentyfour sensors S-1, . . . S-24, at each input there being provided an amplifier which raises the level of the signal from a value of the order of mV to a value of the order of Volts (while maintaining the proportionality of the signal to the flow of current in the respective anode).

In the embodiment illustrated, the multiplexer comprises further twentyfour inlets for further sensors, such as those indicated at S-47 and S-48 in FIG. 3, which furnish to the multiplexer analog voltage signals which are indicative of other parameters of operation of the cell, such as, for example, water temperature at the inlet and outlet ends, the flow rate of the NaCl solution, etc. Some of these signals are already at the level of Volts and do not require amplification, whilst some others may be at a low level (mV) and thus require the presence of amplifiers such as those denoted by 34.

The inquiry section 32 receives the orders through the loop 20 from a memorized program digital computer 36. The normal routine of the computer consists, inter alia, in sequentially inquiring according to the program the 48 inputs of the multiplexer 30 to receive the respective signals, and then doing the same thing for each of the other four remaining cells. To this end, at each of the substations OS-1, . . . OS-5 there corresponds in the control room a master station MS-1, MS-2, . . . MS-5, respectively, through which pass all the communications between the computer and the respective substation. Thus, in the case of the substation OS-3 (FIG. 3), its two loops 18,20 are connected to the master station MS-3. Further, each of the master stations is destined to command the motors of the respective cell. In the case illustrated in FIG. 3, relative to the substation OS-3 of the cell C-3, the master station MS-3 has six command outputs respectively connected to six auxiliary relays R-1, R-2 . . . R-6, from which command lines 37 are directed to the respective motors M-1 . . . M-6 of the cell C-3 (FIG. 2). It is to be understood that, similarly to the prior art, the command lines 37 include remote control switches or other possible auxiliary apparatus, not illustrated here for the purpose of not unduly complicating the drawing.

Due to the memorized program, the computer 36 "knows" the identity of the sensor which is about to be interrogated at a determined moment and to which cell said sensor belongs. For example, when the sensor S-23 of the cell C-3 is to be interrogated the computer sends the inquiry signal through the master station MS-3 to the address of that input of the multiplexer 30 of the substation OS-3 to which the sensor S-23 is connected. With this, the master station MS-3 is informed that the subsequent correction signal (if any) must be sent to the relay R-6, since the sensor S-23 belongs to the anode bank controlled by the motor M-6. In compliance with the request of the computer 36, the multiplexer 30 sends the analog signal of the sensor S-23 to an analog/digital converter 38 forming part of the substation OS-3. The analog signal is thus converted into a corresponding numeric signal, for example composed of 8 bits. The output of the converter 38 therefore comprises eight lines 39 (one for each bit) abutting to an encoder 40. In the case illustrated, the encoder 40 completes the "message" by adding to the eight bits of "information" a start bit, two end bits and a parity bit. The output of the encoder 40 comprises therefore, in the case illustrated, twelve lines 41 which forward the respective bits to a serializing section 42, also forming part of the substation OS-3 together with the encoder 40.

The components 30,32,34,38,40 and 42 are advantageously grouped together in a common cabinet.

The serializing section 42 sends the single bits one after the other (in series) to the master station MS-3 through the loop 18. The master station verifies the authenticity of the message (the possible presence of disturbances), then eliminates the four bits added by the encoder 40 and sends to the computer 36 the eight remaining bits, in parallel along the respective eight output lines 43. If the reading value, thus transmitted to the computer, does not match to value (or range of values) memorized in the computer itself or calculated by it, an error signal is emitted by the computer, as a result of which the master station sends a correction signal to the appropriate relay, in this case to the relay R-6. In each of the lines 37 there is interposed a timer T which, after having received a correction signal from the relative relay, energizes the respective motor for a determined period of time, corresponding to a "unit of correction" conveniently selected, expressed in millimeters of vertical displacement of the respective anode bank. These concepts are already known to those skilled in the art and do not need to be described in detail here. Constructively, the timers T can be in the form of time relays, comprising an R-C circuit of a convenient time-constant, and can be disposed in the same cabinet enclosing the relative substation OS-1, . . . OS-5, respectively.

Instead of producing the fixed time operation of the motor involved, the error signal obtained in the computer can be converted by the computer itself into a corresponding contact time, in such a way that, as a result, the motor is energized for a time proportional to the error revealed, that is in such a way that the corrrection is proportional to the error.

Although in FIG. 3 it was the aim to illustrate a system in which the computer directly intervenes on the anode banks, it is evident that the present invention equally applies to the cases in which the error signals obtained from the computer are transmitted to a command console, and in which the order to raise or lower a determined anode bank originates from the console (that is from the operator) and is subject to the "consent" by the computer, according to the principles already known in the art.

To further increase the reliability of the system, it is advantageous that the apparatus contained in the section 14 in FIG. 3 is made redundant, that is constituted by two identical central control groups, automatically commutable one from the other across a switching unit in which all the loops coming from the single substations converge.

We claim:

1. In a computer-controlled mercury cell plant comprising: a cell room, a mercury cell in the cell room, a control room remote from the cell room, a central control apparatus including a memorized program digital computer in the said control room, the said mercury cell comprising a plurality of vertically adjustable anode banks, each of the banks having a sensor associated therewith arranged to supply an electric analog signal representative of the electric current flow through at least one anode in the bank, electric cable means extending from the cell room to the control room to supply to the central control apparatus information on the anodic current flows based on the analog signals supplied by the sensors, and the said central control apparatus being arranged to vertically adjust each of the said banks in response to its received information to maintain the said flows at selected values, the improvement comprising:

a substation situated in the cell room comprising a multiplexer section, an analog-to-digital converter, an encoder and a serializing section;

said multiplexer section comprising a plurality of inputs connected to the respective sensors and an output connected to the input of the converter, and being connected for inquiry by the central control apparatus through a telephonic loop extending from the said substation to the central control apparatus;

the said converter being arranged to deliver to the encoder digital signals corresponding to its received analog signals; the said serializing section being arranged to receive from the encoder the encoded digital signals and to serialize the latter;

and a telephonic loop extending from the output of the serializing section to the central control apparatus; whereby the aforesaid information signals travelling from the cell room to the control room through said electric cable means are constituted by serialized coded digital signals travelling through the last-mentioned telephonic loop.

2. The improvement of claim 1, wherein the substation is adjacent to one end of the cell.

3. The improvement of claim 1, wherein the substation is situated in front of one end of the cell, at a distance not exceeding two meters.

* * * * *